United States Patent [19]

Shacket et al.

[11] Patent Number: 4,480,420

[45] Date of Patent: Nov. 6, 1984

[54] DORMER STRUCTURE AND METHOD

[75] Inventors: Sheldon Shacket, Southfield; Robert Helfman, Franklin, both of Mich.

[73] Assignee: Trus-Us, Inc., Royal Oak, Mich.

[21] Appl. No.: 580,134

[22] Filed: Feb. 14, 1984

Related U.S. Application Data

[62] Division of Ser. No. 461,024, Jan. 26, 1983, Pat. No. 4,449,334.

[51] Int. Cl.[3] ..... E04G 21/00

[52] U.S. Cl. ..... 52/745; 52/79.3; 52/92

[58] Field of Search ..... 52/745, 79.1, 79.3, 52/79.7, 90, 92, 93, 236.3, 200, 234

[56] References Cited

U.S. PATENT DOCUMENTS

| | | | |
|---|---|---|---|
| 2,980,968 | 4/1961 | Jones | 52/745 |
| 3,089,201 | 5/1963 | Helfman | 52/90 |
| 3,722,171 | 3/1973 | Godley | 52/90 |
| 3,965,624 | 6/1976 | Madonna | 52/28 |
| 3,990,197 | 11/1978 | Johnson | 52/125.2 |
| 4,003,182 | 1/1977 | Wokas | 52/745 |
| 4,050,215 | 9/1977 | Fisher | 52/79.3 |

FOREIGN PATENT DOCUMENTS

| | | | |
|---|---|---|---|
| 2411283 | 8/1979 | France | 52/90 |
| 1209785 | 10/1970 | United Kingdom | 52/79.1 |
| 1433385 | 4/1976 | United Kingdom | 52/90 |

OTHER PUBLICATIONS

Home Planners 230 Homes by Richard B. Pollman ©Home Planners Inc., 1974 pp. 44, 80, 120, 123, 181.

*Primary Examiner*—Henry E. Raduazo

*Attorney, Agent, or Firm*—Barnes, Kisselle, Raisch, Choate, Whittemore & Hulbert

[57] ABSTRACT

Dormer construction comprising a dormer having two parallel spaced apart side walls having no openings therein consisting of a frame with sheet material both nailed and glued thereto on both sides thereof whereby the parallel spaced apart side walls form beam structures. The dormer is substantially rectangular and has lift members at the four corners thereof for lifting it into position in a house and includes a flashing on the exterior thereof along an opening in a roof in which the dormer is to be positioned for facilitating weather proofing between the dormer and the roof.

The method of constructing such a dormer and lifting it into position in an opening cut in the roof of a house having spaced apart exterior bearing walls whereby the spaced apart parallel dormer walls act as beams to support the dormer from the bearing walls of the house.

3 Claims, 3 Drawing Figures

FIG.1
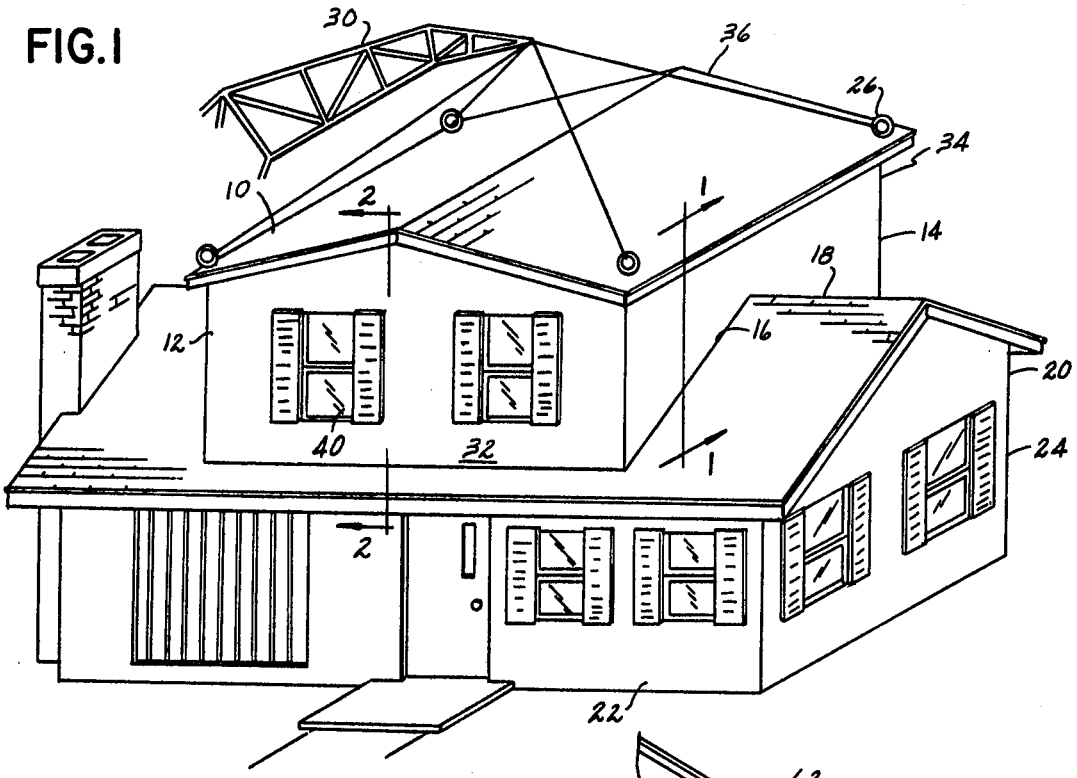
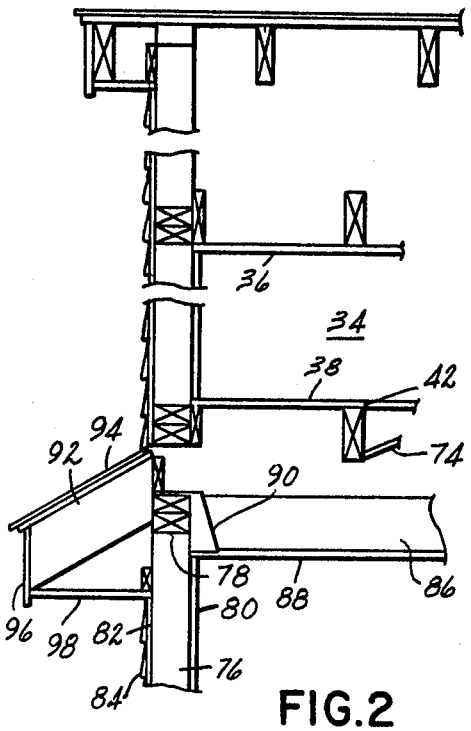
FIG.2
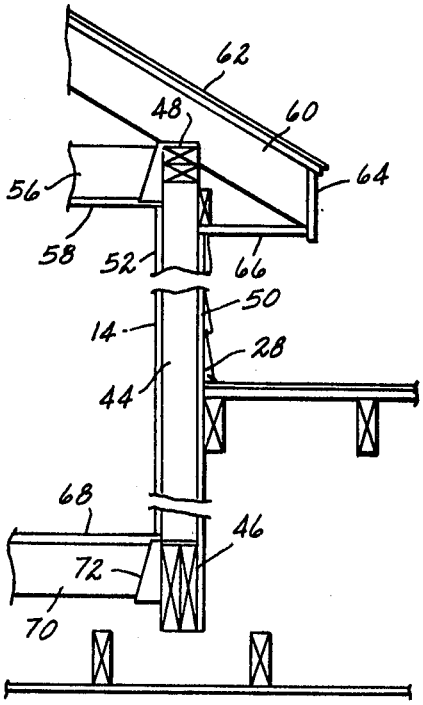
FIG.3

DORMER STRUCTURE AND METHOD

This is a division of application Ser. No. 461,024 filed Jan. 26, 1983, and now U.S. Pat. No. 4,449,334.

BACKGROUND OF THE INVENTION

1. Field of the Invention

The invention relates to dormer structures and methods and refers more specifically to a dormer structure having two parallel spaced apart side walls constructed as beams which dormer structure includes means at the four corners thereof for lifting the dormer into position in an opening in roof structure of a building in which a dormer is to be installed and flashing secured to the dormer around the exterior thereof on a line adjacent the opening in the roof structure in which the dormer is to be installed.

The dormer structure of the invention is installed by lifting the dormer into an opening cut in the roof structure of a building in which it is to be installed and placing the dormer so that the ends of the parallel spaced apart side walls acting as beams rest on bearing walls of the building structure which are the sole support of the dormer in accordance with the method of the invention.

2. Description of the Prior Art

In the past, dormer structures for building structures especially dormer structures for houses added after the houses have been built have been constructed within an opening cut in the roof structure of the house. The dormer construction of the past has required days or even weeks to complete, thus requiring the opening in the roof to be maintained for a considerable period of time. Maintaining the opening the roof for any considerable period of time is undesirable due to the vagarities of weather and is particularly undesirable in winter during cold weather.

Further, the construction of a dormer at the roof level of a house from individual pieces of lumber and the like requires a considerable amount of time even under the best circumstances and is somewhat dangerous for workmen.

Accordingly, with prior dormer structure and methods of construction, there is risk of damage to the building structure in which the dormer is to be placed and to the surrounding site as well as risk of injury to workmen. Dormer construction is thus more complicated and expensive than necessary using prior structures and methods.

SUMMARY OF THE INVENTION

The present invention provides novel dormer structure combined with building structure which is constructed and positioned in accordance with unique construction methods.

The dormer structure is generally rectangular and includes the floor and roof structure and at least two parallel spaced apart side walls. The two parallel spaced apart side walls have no openings therein and are constructed of a frame having sheet material both nailed and glued thereto on both sides thereof whereby the two parallel spaced apart side walls form rigid beams capable of supporting the dormer structure from the opposite ends thereof.

In accordance with the method of the invention, the dormer structure of the invention is positioned in an opening cut in the roof structure of a building structure such as a house having exterior spaced apart parallel bearing walls. The dormer structure of the invention is positioned with the parallel spaced apart side walls thereof extending between the exterior bearing walls of the house whereby the dormer structure is supported only by the bearing walls of the house.

In addition, the dormer structure of the invention is provided with flashing means secured thereto around the line at which the dormer structure in position in the roof structure of the house makes with the opening in the roof structure of the house to facilitate weather proofing between the dormer structure and roof structure.

In accordance with the method of the invention, the dormer structure is constructed as indicated above and is provided with lifting means such as eye-lets for hooks at the four corners thereof in the ends of the beams formed by the parallel spaced apart dormer walls whereby the dormer structure completed at a remote site in a factory may be lifted from transportation means such as a truck or the like and positioned in a newly prepared opening in a home or the like on bearing walls by means of a crane or a similar lifting device.

With such methods, the roof structure of a house need only be opened for a very short time and the dormer structure may be completely installed in a matter of hours. Further, with such methods, the construction is faster and with less danger to workmen.

Such dormer construction and method of construction thus makes the addition of a dormer to a dwelling more efficient and economical and safer than it has been in the past.

BRIEF DESCRIPTION OF THE DRAWINGS

FIG. 1 is a perspective view of a house having front and back bearing walls and a dormer constructed in accordance with the invention by the methods of the invention positioned in the roof structure of the house.

FIG. 2 is an enlarged cross section of a portion of the dormer structure and house illustrated in FIG. 1 taken substantially on the line 2—2 in FIG. 1.

FIG. 3 is another enlarged cross section of a portion of the dormer structure and house illustrated in FIG. 1, taken substantially on the line 3—3 in FIG. 1.

DESCRIPTION OF THE PREFERRED EMBODIMENT

As shown best in FIG. 1, a dormer structure 10 according to the invention constructed in accordance with the method of the invention is shown in position on a house 12 having front and back bearing walls 22 and 24 respectively. The dormer 10 includes means 26 at the four corners thereof for lifting the dormer 10 in position on the building structure 20 and flashing means 28 for facilitating weather proofing between the dormer structure 10 and building structure 20.

In accordance with the method of the invention, the dormer 10 may be constructed at a remote location shipped to the site of the building structure 20 and lifted into position on the building structure 20 by convenient means such as the crane 30. Further, the exterior walls 12 and 14 as shown are constructed with no openings therethrough and with sheet material both glued and nailed to an inner frame. The walls 12 and 14 are supported only at their ends on the bearing walls 22 and 24 of the building structure 20, in accordance with the method of the invention.

Thus, the provision of dormer structure 10 on the building structure 20 in accordance with the structure and method of the invention is accomplished with a minimum of open time for the roof structure 18 of the building structure 20. Further, since the dormer structure 10 is constructed at a remote location such as a factory the construction is most efficient and may be completed in the least time with the least expense and danger to workmen. Accordingly, the provision of a dormer structure 10 on the building structure 20 in accordance with the structure and method of the invention should be accomplished with the least possibility of damage to the building structure 20 and surrounding site most economically.

More specifically, the dormer 10 as shown includes a front wall 32 and a rear wall 34 in addition to the side walls 12 and 16. Also, the dormer is provided with roof structure 36 and floor structure 38 best shown in FIG. 2.

Windows 40 may be provided as desired in walls 32 and 34. Also, an opening 42 designated in FIG. 2 may be provided any place desired in the floor structure 38 to permit entrance to and exit from the dormer 10 from the building structure 20, which as shown is a house, by means of a stairway not shown.

More specifically and particularly in accordance with the present invention, the side walls 12 and 14 as indicated above are void of window structure or other openings and extend in parallel spaced apart relation on the opposite sides of the dormer 10. The ends of the side walls 12 and 14 rest on the front and back bearing walls 22 and 24 of the house 20 to completely support the dormer 10 in accordance with the invention.

Further, in accordance with the present invention and as shown in more detail in FIG. 3, each of the side walls 12 and 14 are constructed as beams. Only the side wall 14 will be considered in detail since the side walls 12 and 14 are substantially identical.

As shown in FIG. 3, the side wall 14 includes an inner wood frame 44 constructed of two by four vertical stud members secured to two by six or two by eight horizontal members sill 46 at the bottom thereof and two by four horizontal plate members 48 at the top thereof. The individual members of the sill and plate members 46 and 48 are nailed together so that they act as a unit.

Diagonal bracing is provided between the two by four stud members 44 which may extend between the plate and sill members 46 and 48 as desired for strength and stiffness in accordance with normal truss design.

Sheet material such as exterior plywood 50 and interior paneling 52 which may if desired also be of plywood or the like is both glued and nailed to the opposite sides of the wood frame 44.

The structure of the dormer side walls 12 and 14 is thus essentially a beam including the entire side wall. Further, the side walls 12 and 14 as so constructed in conjunction with the floor structure 46 and ceiling structure 36 effectively makes the entire dormer 10 a very large box beam which is supported at its opposite ends on the front bearing wall 22 and rear bearing wall 24 of the house 20.

Such construction readily permits remote manufacture of the dormer 10, transportation of the dormer to a site without damage thereto and placing the dormer 10 in an opening 16 in roof structure 18 of the house 20 by lifting the dormer 10 into position by means of the crane 30, for example. Thus, the particular dormer structure 10 is primarily responsible for the possibility of effecting the method of the invention.

Further, in accordance with the invention, the dormer structure 10 is provided with flashing 28, which may be of plastic, metal or asphaltic material composition along a line on the exterior thereof as shown in FIGS. 1 and 3. The flashing 28 is provided along the outline of the opening 16 in the roof structure 18. The flashing 28 as shown best in FIG. 3 facilitates weather proofing between the dormer 10 and the house 20 in conjunction with the application of tar or other sealing material in accordance with usual roof flashing procedures.

As shown in FIG. 3, the flashing 28 may be secured to the exterior walls of the dormer 10 by convenient means such as nails beneath the exterior siding 84 which may be applied to the sheet material 50 to match the exterior decor of the house 20.

The means 26 for facilitating lifting the dormer 10 by means of the crane 30 or the like are eye members adapted to receive hooks positioned at the four corners of the dormer structure 10 which may be set in the plate members 48 of the walls 12 and 14 and/or in reinforcing therein. The eye 26 may if desired be removable that is have a nut and screw connection to the dormer 10 if desired. Alternatively, they may be made in a decorative configuration to enhance the esthetic appearance of the dormer 10.

The front and rear walls 32 and 34 of the dormer 10 may be of the usual sill, stud and plate construction having the windows 40 therein.

Similarly, the roof structure 36 may be peaked as shown and include ceiling rafters 56, ceiling structure 58 which for example may be drywall, plasterboard or the like, roof joists 60 and roofing 62. As shown best in FIG. 3, the roof structure 36 may be completed by the usual closing and trim members 64 and 66.

Floor structure 38 includes the flooring material 68, floor joists 70, supported from metal hangers 72, from the sill members 46 as shown best in FIG. 3. Cross bracing 74 is provided in accordance with the usual floor construction to stabilize the floor joists 70 as required. It will be noted that the floor and ceiling joists extend transversely or substantially perpendicularly to the side walls 12 and 14 as do the roof joists 60 to provide the overall box beam dormer construction as mentioned above.

The home 20 as set forth above may be any standard home having a roof structure and having a pair of substantially parallel spaced apart bearing walls such as exterior bearing walls 22 and 24, as shown, whereby the dormer 10 may be placed in the opening 16 in the roof structure 18 and rested on the front and back bearing walls, on the ends of the walls 12 and 14 in accordance with the invention. Such structure is particularly advantageous in that there is no contact between the dormer floor structure and the building structure 20 between the bearing walls whereby sound transmission is maintained at a minimum.

As referenced above, stair structure may be provided between the house 20 and the dormer 10 to permit entrance and exit from the dormer 10 from the house 20 through the opening generally indicated at 42 in FIG. 2.

With further regard to FIGS. 2 and 3, the building structure 20 is of common construction including the structure of the bearing wall 22 and 24. For example, bearing wall 22 includes studs 76 which may be two by fours, a two by four plate 78, interior wall board 80, exterior sheeting 82 and siding 84.

Further, as shown the house 20 further includes the ceiling joists 86 and ceiling material such as gypsum or other drywall material 88, supported from the plate 78 on metal brackets 90.

Also as shown in FIG. 2, the roof structure 18 of the building structure 20, includes the roof joists 92 roofing material 94 and the closing and decorative members 96 and 98 which are common in house construction.

Having thus described the structure of the invention, the method of the invention will now be considered in more detail.

In accordance with the method of the invention, the entire dormer structure 10 is produced at a remote location as for example in a factory. The dormer 10 so produced will include the means for facilitating lifting of the dormer 26 and the flashing structure 28. The dormer 10 is then shipped to a site as by rail or truck.

The roof structure 18 of the house 20 is opened at 16 to receive the dormer. Note that in accordance with the invention, the roof structure 16 is opened to coincide with the arrival of the dormer 10 at the building site to minimize the time which the roof structure 18 is opened.

The dormer structure 10 is then lifted from the transporting vehicle such as the truck, by means of a crane 30 which may be attached to the transporting truck and set substantially completely finished in the opening 16, leveled as by means of shims or the like or if desired with leveling members secured to the bottom of the dormer at the ends of the beams 12 and 14 and the dormer structure 10 is secured in place on the house 20 as by means of nailing or the like.

The area between the dormer 10 and building 20 at the opening 16 in the roof structure 18 is then waterproofed as by flashing 28 and/or sealing and roofing material such as tar, gravel and the like. The dormer structure 10 is then ready for use in conjunction with a stairway entry thereto which may be constructed in the home 20 prior to or after installation of dormer 42.

While one embodiment of the present invention has been considered in detail, it will be understood that other embodiments and modifications thereof are contemplated by the inventor. It is the intention to include all embodiments and modifications as are defined by the appended claims within the scope of the invention.

We claim:

1. The method of modifying a building structure having two parallel spaced apart bearing walls and a roof structure comprising cutting an opening in the roof structure between the bearing walls, separately constructing a dormer, lifting the dormer into position in the opening in the roof structure and positioning it so that it bears on the bearing walls of the building structure.

2. The method as set forth in claim 1, and further including the steps of constructing the dormer with parallel spaced apart exterior walls having no openings therein and positioning the parallel spaced apart dormer walls between the building structure bearing walls whereby the parallel spaced apart dormer walls act as beams to support the dormer.

3. The method as set forth in claim 2, wherein the parallel spaced apart dormer walls are constructed of a frame and sheet material nailed and glued to both sides of the frame.

* * * * *